US008522506B2

(12) United States Patent
Barnet et al.

(10) Patent No.: US 8,522,506 B2
(45) **Date of Patent: *Sep. 3, 2013**

(54) SYSTEM FOR THE PLACEMENT OF MODULAR FILL MATERIAL FORMING CO-JOINED ASSEMBLIES

(75) Inventors: Robert T. Barnet, Fort Collins, CO (US); Bradley J. Barnet, Fort Collins, CO (US); Donald H. Dworkes, Cape Coral, FL (US)

(73) Assignee: ThermoFormed Block Corp., Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/473,402

(22) Filed: May 16, 2012

(65) Prior Publication Data

US 2012/0222384 A1 Sep. 6, 2012

Related U.S. Application Data

(63) Continuation of application No. 11/572,203, filed as application No. PCT/US2005/025315 on Jul. 15, 2005, now Pat. No. 8,181,418, which is a continuation of application No. 10/893,593, filed on Jul. 15, 2004, now abandoned.

(51) Int. Cl.
*E04B 2/26* (2006.01)
*E04B 2/84* (2006.01)

(52) U.S. Cl.
USPC ..... 52/742.13; 52/742.14; 52/127.2; 52/127.1; 52/434

(58) Field of Classification Search
USPC ..... 52/127.3, 127.2, 421, 422, 426, 425, 52/434, 742.1, 742.13, 742.14, 742.15; 249/34, 249/44–45, 47
See application file for complete search history.

(56) References Cited

U.S. PATENT DOCUMENTS

| | | | | |
|---|---|---|---|---|
| 1,219,272 | A | 3/1917 | Edison | |
| 1,226,214 | A | 5/1917 | Hopkins | |
| 1,482,434 | A | 2/1924 | Hotchkiss | |
| 1,588,229 | A * | 6/1926 | Hotchkiss | 249/45 |
| 1,702,964 | A * | 2/1929 | Goudis | 52/425 |
| 1,732,243 | A | 10/1929 | Nelson | |
| 1,743,136 | A * | 1/1930 | Harrold | 249/192 |
| 2,019,195 | A | 10/1935 | Simpson | |
| 2,107,427 | A | 2/1938 | Schwarzler | |
| 2,332,166 | A | 10/1943 | Reiner | |
| 2,511,584 | A * | 6/1950 | Hill | 249/27 |
| 2,526,529 | A | 10/1950 | Arrighini et al. | |

(Continued)

FOREIGN PATENT DOCUMENTS

WO 2006020143 A2 2/2006

OTHER PUBLICATIONS

Parallel U.S. Appl. No. 11/893,593, Office Action dated Nov. 25, 2011.

(Continued)

*Primary Examiner* — Phi A
(74) *Attorney, Agent, or Firm* — Santangelo Law Offices, P.C.

(57) ABSTRACT

A system for the placement of modular fill material forming co-joined assemblies that promotes increased efficiency in fill material building methods by utilizing the capabilities of aerial conveyance devices, the pre-assembly of forms, the rapid bracing of forms, and the sequential placement of enclosure forms.

19 Claims, 9 Drawing Sheets

(56) References Cited

U.S. PATENT DOCUMENTS 2,701,065 A * 2/1955 Bertel ..... 414/239
3,168,772 A 2/1965 Williams
3,229,950 A 1/1966 MacRobbie
3,236,019 A 2/1966 Ballou
3,315,424 A 4/1967 Smith
3,394,523 A 7/1968 Sackett, Sr.
3,438,161 A * 4/1969 Koch ..... 52/127.3
3,461,639 A 8/1969 Merrill
3,530,631 A 9/1970 Guddal
3,555,751 A 1/1971 Thorgusen
3,574,981 A 4/1971 Henschen
3,686,815 A 8/1972 Von Bose
3,700,202 A 10/1972 Donnels
3,743,232 A 7/1973 Vaughan
3,748,805 A 7/1973 Boros
3,751,864 A 8/1973 Berger et al.
3,788,026 A 1/1974 Cook
3,817,006 A 6/1974 Williams
3,876,099 A 4/1975 Land
3,950,902 A 4/1976 Stout
4,029,287 A 6/1977 Burdett
4,033,544 A 7/1977 Johnston
4,038,798 A 8/1977 Sachs
4,068,427 A 1/1978 Camardo
4,104,837 A 8/1978 Naito
4,136,492 A 1/1979 Willingham
4,249,870 A 2/1981 Krabbe et al.
4,314,430 A 2/1982 Farrington
4,374,790 A 2/1983 McGowan
4,441,685 A 4/1984 Greeson
4,532,745 A 8/1985 Kinard
4,553,729 A 11/1985 Connors
4,557,099 A 12/1985 Johnson
4,604,843 A 8/1986 Ott et al.
4,731,971 A 3/1988 Terkl
4,765,109 A 8/1988 Boeshart
4,823,534 A 4/1989 Hebinck
4,862,660 A 9/1989 Raymond
4,901,494 A 2/1990 Miller et al.
4,916,879 A 4/1990 Boeshart
4,924,641 A 5/1990 Gibbar, Jr.
4,936,540 A 6/1990 Boeshart
4,938,449 A 7/1990 Boeshart
4,967,528 A 11/1990 Doran
4,974,700 A 12/1990 Gates
4,998,394 A 3/1991 Holzapfel et al.
5,038,541 A 8/1991 Gibbar, Jr.
5,039,058 A 8/1991 Boeshart
5,040,344 A 8/1991 Durand
5,055,252 A 10/1991 Zimmerman
5,088,578 A 2/1992 Gates
5,323,578 A 6/1994 Chagnon et al.
5,339,592 A 8/1994 Schmid
5,381,633 A 1/1995 Hendrich
5,390,459 A 2/1995 Mensen
5,454,199 A 10/1995 Blom et al.
5,456,444 A 10/1995 Wegman
5,459,971 A 10/1995 Sparkman
5,465,542 A 11/1995 Terry
5,488,806 A 2/1996 Melnick et al.
5,497,592 A 3/1996 Boeshart
5,511,353 A 4/1996 Jones
5,535,565 A 7/1996 Majnaric et al.
5,582,388 A 12/1996 Baxter
5,598,675 A 2/1997 Pruss
5,611,182 A 3/1997 Spude
5,625,989 A 5/1997 Brubaker et al.
5,649,401 A 7/1997 Harrington, Jr.
5,651,910 A 7/1997 Myers et al.
5,664,382 A 9/1997 Melnick et al.
5,678,373 A 10/1997 Franklin et al.
5,692,356 A 12/1997 Baxter
5,782,050 A 7/1998 Boeshart
5,799,399 A 9/1998 Schultz
5,802,793 A 9/1998 DeVore, Jr.
5,809,726 A 9/1998 Spude
5,833,873 A 11/1998 Adonetti
5,836,126 A 11/1998 Harkenrider et al.
5,839,243 A 11/1998 Martin
5,852,907 A 12/1998 Tobin et al.
5,857,300 A 1/1999 Gates
5,861,105 A 1/1999 Martineau
5,902,075 A 5/1999 Krings
5,921,046 A 7/1999 Hammond, Jr.
5,922,236 A 7/1999 Zuhl
5,965,053 A 10/1999 Carlson
5,987,827 A 11/1999 Lord
5,987,830 A 11/1999 Worley
5,992,114 A 11/1999 Zelinsky et al.
6,024,339 A 2/2000 Gates
6,026,620 A 2/2000 Spude
6,052,963 A 4/2000 Lefort et al.
6,058,672 A 5/2000 McClellan
6,070,380 A 6/2000 Meilleur
6,079,175 A 6/2000 Clear
6,079,176 A 6/2000 Westra et al.
6,085,476 A 7/2000 Jantzi et al.
6,119,418 A 9/2000 Johnson
6,134,861 A 10/2000 Spude
6,161,355 A 12/2000 Gratt
6,173,937 B1 1/2001 Cottongim
6,178,711 B1 1/2001 Laird et al.
6,205,728 B1 3/2001 Sutelan
6,230,462 B1 5/2001 Beliveau
6,237,890 B1 5/2001 Gates
6,247,273 B1 6/2001 Nickel
6,279,285 B1 8/2001 Kubica
6,293,067 B1 9/2001 Meendering
6,293,068 B1 9/2001 Harrington, Jr.
6,305,142 B1 10/2001 Brisson et al.
6,314,697 B1 11/2001 Moore, Jr.
6,321,498 B1 11/2001 Trovato
6,363,683 B1 4/2002 Moore, Jr.
6,378,260 B1 4/2002 Williamson et al.
6,401,419 B1 6/2002 Beliveau
6,405,504 B1 6/2002 Richardson
6,405,505 B1 6/2002 Alberti
6,419,205 B1 7/2002 Meendering
6,438,917 B2 8/2002 Kubica
6,438,918 B2 8/2002 Moore, Jr. et al.
6,519,906 B2 2/2003 Yost et al.
6,530,553 B1 3/2003 Diorio et al.
6,568,651 B2 5/2003 Reid
6,601,820 B2 8/2003 Hambelton
6,605,240 B2 8/2003 Hambelton
6,622,452 B2 9/2003 Alvaro
6,625,947 B1 9/2003 Burgett
6,647,686 B2 11/2003 Dunn et al.
6,668,503 B2 12/2003 Beliveau
6,691,481 B2 2/2004 Schmidt
6,698,710 B1 3/2004 VanderWerf
6,739,102 B2 5/2004 Roy, Sr.
6,983,567 B2 1/2006 Ciotti
7,143,554 B2 12/2006 Sachs et al.
7,191,572 B2 3/2007 Izquierdo
7,444,793 B2 11/2008 Raftery et al.
2002/0003061 A1 1/2002 Philippe
2002/0017070 A1 2/2002 Batch
2002/0026760 A1 3/2002 Moore, Jr.
2002/0121586 A1 9/2002 Gates
2003/0014933 A1 1/2003 Worley
2003/0041555 A1 3/2003 Scallan et al.
2003/0168575 A1 9/2003 Fearn et al.
2003/0213765 A1 11/2003 St-Germain
2004/0045237 A1 3/2004 Coombs et al.
2004/0103609 A1 6/2004 Wostal et al.
2004/0200168 A1 10/2004 Takagi et al.
2004/0226259 A1 11/2004 Barnet et al.

OTHER PUBLICATIONS

Parallel U.S. Appl. No. 10/893,593; Office Action dated Aug. 8, 2007.

Parallel U.S. Appl. No. 10/893,593; Office Action dated Jul. 7, 2008.

Parallel U.S. Appl. No. 10/893,593; Office Action dated Jul. 21, 2009.
Parallel U.S. Appl. No. 10/893,593; Office Action dated Sep. 17, 2010.
Concrete Gates Forming Systems, Gang Forms; gatesconcreteforms.com; printed Jul. 9, 2004; 5 pages.
Concrete Homes, Jul. 2004; Nudura Integrated Building Technology, Building Efficiency, Advertisement, p. 43.
Insulating Concrete Form Association, Project Files, Project Capsule Hilton Gardens Inn, Omaha, NE; forms.org/project_files/index.html, Apr. 11, 2002; 1 page.
Lite-Form Concrete Systems; http://webster.liteform.com; Jun. 5, 2004; 2 pages.
Lite-Form Concrete Systems; Buck-a-Foot form; http://webster.liteform.com; Jun. 5, 2004; 10 pages.
Lite-Form Concrete Systems, Features and Benefits; http://webster.liteform.com/features.htm; Jun. 5, 2004; 2 pages.
Lite-Form Concrete Systems, Frequently Asked Questions; http://webster.liteform.com/faq.htm; Jun. 5, 2004; 4 pages.
Lite-Form Concrete Systems, Pre-Assembled Commercial Project; http://webster.liteform.com; Jun. 5, 2004; 12 pages.
Lite-Form Concrete Systems, Technical Specs; http://webster.liteform.com/Technical_Specs.htm; Jun. 5, 2004; 2 pages.
Lite-Form Concrete Systems, Installation Guide to Insulated Concrete Construction, Details for Builders and Designers, 2nd Edition, Jan. 2000.
Northwest Accessories Incorporated, Rebar Buddy TM; http://rebarbuddy.com/home.html; printed May 22, 2004; 10 pages.
Permanent Buildings and Foundations; May 15, 2004; Celblox, Be Freed from High Costs! Advertisement, p. 31.
Permanent Buildings and Foundation, Jul. 1, 2004, PM Model 39028LC, Advertisement, p. 28.
Permanent Buildings and Foundation, Jul. 1, 2004; Reddi-Wall, Advertisement, p. 28.
Premere Insulated Concrete Forms, Press Release and Brochure, Dec. 2002; 2 pages.
R-Control ICF (Insulated Concrete Form), http://www.bsiinc.com/products/building_productsj/building/icf/icf.asp; May 22, 2004; 5 pages.
Reddi-Wall, Inc., Product Profile; http://www.reddi-wall.com/Profile.htm, Jul. 6, 2004.
International Application No. PCT/US2005/025315; International Search Report dated Jun. 9, 2006.
International Application No. PCT/US2005/025315; International Written Opinion dated Jun. 9, 2006.
Parent U.S. Appl. No. 11/572,203, filed Jan. 16, 2007.

* cited by examiner

SYSTEM FOR THE PLACEMENT OF MODULAR FILL MATERIAL FORMING CO-JOINED ASSEMBLIES

CROSS REFERENCE TO RELATED APPLICATIONS

This application is a continuation of, and claims benefit of and priority to, U.S. patent application Ser. No. 11/572,203, filed Jan. 16, 2007 now U.S. Pat. No. 8,181,418, which is the United States National Stage of International Application No. PCT/US2005/025315, filed Jul. 15, 2005, which is a continuation of, and claims benefit of and priority to, U.S. Nonprovisional patent application Ser. No. 10/893,593, filed Jul. 15, 2004, each said patent application and any priority case hereby incorporated herein by reference in its entirety.

BACKGROUND OF THE INVENTION

Generally, this invention relates to a system for creating hardened structural forms made out of a fill material such as concrete. Specifically, the invention includes methods and apparatus for placing forming structures that are used to create such hardened forms. The invention is particularly suited for aerial transportation of forming structures to create high-rise building structures.

The use of insulating concrete forms to create concrete building structures increasingly is becoming a popular choice for building in the construction industry. Using insulating concrete forms as a building method typically involves placing a concrete form having a hollow interior into which concrete can be poured. Upon hardening, the concrete provides a hardened form that can be used as a component of a building structure, for example, a wall. In the case of insulating concrete forms, the form itself may be made out of an insulating material or have an insulating material attached. After the concrete hardens, the insulating material can be left in place, resulting in a hardened structure with both the building properties of concrete and the insulating properties of the form.

When compared to traditional building methods, such as wood framing, the use of insulating concrete forms offers many attractive advantages. Building structures made out of concrete typically are more durable and long-lasting than their non-concrete counterparts. This can be an important consideration in areas prone to natural events such as hurricanes or earthquakes. Concrete building structures also may require a reduced time and cost for maintenance than building structures made using other types of building methods. In the case of insulating concrete forms, the insulating properties of the form add further benefits such as increased energy efficiency and noise reduction within the interior of the building structure. Further, the popularity of this kind of building method may only increase as advances are made in the state of the art. For example, concrete may no longer be the fill material of choice as other kinds of fill materials are explored, and insulating forms may no longer be required as other methods of insulation may be developed.

Despite these advantages, building with fill materials still entails significant problems related to efficiency and cost-effectiveness that largely have not been overcome. One problem posed by conventional fill material building methods relates to the method of placing forms. Many techniques still rely on manual labor to individually place forms one at a time. This entails significant drawbacks including large work crews required to perform this labor-intensive task and extended periods of time in which to accomplish placement of the forms. Certain improvements over manual labor techniques have been realized in the field. For example, the use of a crane to place forms has been described in U.S. Pat. No. 6,530,553, as well as in various industry publications and proprietary websites. While the use of a crane does reduce the size of the work crew needed and increases the rate at which forms may be placed, it is somewhat remarkable that none of the foregoing applications has realized the full potential to which a crane may be used. For example, U.S. Pat. No. 6,530,553 is limited to the use of a crane to place interior room forms within a pre-established outside perimeter wall form. This type of technique relies on using forms fabricated into shapes and configurations for use on a particular job and overlooks the benefit of using standardized forms that can be assembled into a variety of configurations. However, even techniques using standardized forms have failed to appreciate the full capabilities of using a crane. For example, some industry publications and websites merely disclose using a crane to transport a pallet of forms to a site of assembly. While this reduces some of the labor and time costs associated with placing forms by increasing the efficiency of transporting forms to an assembly site, manual labor with all of its drawbacks may be still required to place the forms at the assembly site. Finally, even techniques in which a crane is used to place a form have until now failed to fully understand the potential to which a crane may be used. For example, some proprietary websites actually illustrate a form connected to a crane with a caption stating that the particular crane advertised is ideal for handling gang forms. Nevertheless, no disclosure is made of a joined form connected to a crane. This collection of seemingly unattached forms is then moved to a placement location.

Another problem posed by conventional fill material building methods relates to the pre-assembly of forms. Building methods involving fill materials frequently call for placing metal reinforcement bars, or rebar, within a form to strengthen the final hardened form. Many techniques for placing rebar require using manual labor at an installation location. Again, this may entail significant drawbacks, perhaps including large work crews required to perform this labor-intensive task and extended periods of time in which to accomplish placement of the rebar. This technique may fail to appreciate the value of preloading rebar into a form and placing the form at an installation location with rebar already loaded. However, while certain industry publications and propriety websites acknowledge the value of preloading rebar, even these sources fail to fully appreciate the full benefit of how this may be accomplished. For example, certain proprietary websites illustrate a crane lifting a pallet of forms with loaded rebar to a location for placement at an assembly site. Again, however, this method requires manual labor with all of its associated drawbacks to place the forms once they reach the assembly site.

A further problem relates to placing forms on high-rise structures. Construction techniques for building high-rise structures frequently employ cranes, and some industry publications and proprietary websites indicate the use of a crane to lift forms to a high-rise location or perhaps more than one story above the ground. However, even these sources may to some degree fail to fully appreciate the degree to which one might be able to increase the efficiency of high-rise construction. Consequently, these techniques have failed to fully appreciate the usefulness of a crane in fill material building methods at high-rise locations.

Yet another problem relates to bracing forms that have been placed. Typically, a placed form requires bracing to hold it in place against, for example, wind loads that may develop on the cross-sectional area of a placed form. One typical method for bracing a placed form involves the use of a kicker. However, positioning a kicker so that it is properly aligned to the form and so that the form is properly plumb frequently entails a time-intensive manual procedure. This procedure may further be complicated by the necessity of solidly securing the kicker to the form. While the time required to accomplish this for an individual kicker may not be significant, a typical construction job will require many kickers to be placed. This may cause the total time required to position kickers to become a significant expense. Existing methods of positioning kickers may not promote efficiency in accomplishing this task. For example, U.S. Pat. No. 4,068,427 requires a track to be installed on a form to which a kicker may be connected. U.S. Pat. No. 4,068,427 further does not allow the kicker to be placed against the form in a continuously adjustable manner. These techniques fail to appreciate the efficiency of connecting a kicker directly to a form.

An additional problem relates to methods for placing forms in corner locations and other locations that may need to be enclosed. Many techniques do not accommodate special conditions for corners of the like. For example, building methods involving fill material forms frequently require an opening between two forms to be closed. Generally, this can involve placing rebar into the opening, connecting to the rebar of the adjoining forms, and closing the opening with an inner panel and an outer panel. It may normally be the case that the rebar may be placed first and the form subsequently closed with an inner panel and an outer panel. However, high-rise building methods can present special circumstances. Specifically, it may be the case that an exterior wall located more than one story above the ground may be practically accessed only from the interior of the building. Many conventional systems may even require simultaneous placement of both the inner panel and the outer panel, which may limit the opportunity to place rebar into a space between the forms. Consequently, conventional building systems may fail to accommodate this aspect of high-rise construction.

One more problem may relate to further techniques for bracing forms. Many techniques do not accommodate special conditions in which the placement location of a brace may be important. For example, in high-rise construction, it may not be practical to place a brace on the exterior side of an exterior wall located more than one story above the ground. Consequently, conventional techniques that require a brace to be placed on both sides of a form may have limited application in high-rise building construction.

The foregoing problems regarding fill material building methods may represent a long-felt need for an effective solution. While implementing elements may have been available, actual attempts to meet this need may have been lacking to some degree. This may have been due to a failure of those having ordinary skill in the art to fully appreciate or understand the nature of the problems and challenges involved. As a result of this lack of understanding, attempts to meet these long-felt needs may have failed to effectively solve one or more of the problems or challenges here identified. These attempts may even have led away from the technical directions taken by the present invention and may even result in the achievements of the present invention being considered to some degree an unexpected result of the approach taken by some in the field.

SUMMARY OF THE INVENTION

Accordingly, the present invention provides a system for the placement of modular fill material forming co-joined assemblies. Some embodiments of the invention may include placing specialized modular fill material forming co-joined assemblies through the use of an aerial conveyance device such as a crane. Other embodiments of the invention may involve pre-assembling specialized forms for use with an aerial conveyance device. Further embodiments of the invention may include methods and apparatus for bracing forms that have been placed. Still further embodiments of the invention may involve methods and apparatus for closing corners and other types of openings formed between modular fill material forming co-joined assemblies. Some embodiments of the invention may involve placing and bracing pre-assembled specialized modular fill material forming co-joined assemblies with an aerial conveyance device and closing corners and other types of openings formed between such structures after they are placed and braced. Certain embodiments of the invention may be particularly useful for high-rise construction projects. It may be the case that embodiments of the current invention may increase the time and cost efficiencies of building methods that utilize fill material forms.

A significant object of the invention may be to increase the time and cost efficiencies of placing fill material forms.

In keeping with this object, it may be a goal of the invention to increase the effectiveness of using an aerial conveyance device such as a crane to place fill material forms.

In further keeping with this object, it may be a goal of the invention to increase the effectiveness of using pre-assembled fill material forms with an aerial conveyance device such as a crane.

In further keeping with this object, it may be a goal of the invention to increase the effectiveness of bracing forms that have been placed using an aerial conveyance device such as a crane.

In further keeping with this object, it may be a goal of the invention to increase the effectiveness of closing corners and other types of openings that may be part of the process of using building methods involving fill material forms.

In further keeping with this object, it may be a goal of the invention to facilitate the use of fill material building methods in high-rise construction projects.

Naturally, further objects and goals of the invention will become apparent from the description and drawings below.

DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should further be understood to support and encompass descriptions and claims of all the various embodiments, systems, techniques, methods, devices, and applications with any number of the disclosed elements, with each element alone, and also with any and all various permutations and combinations of all elements. Accordingly, methods and apparatus are disclosed for the placement of modular fill material forming co-joined assemblies in certain embodiments of the invention.

Figure 1:
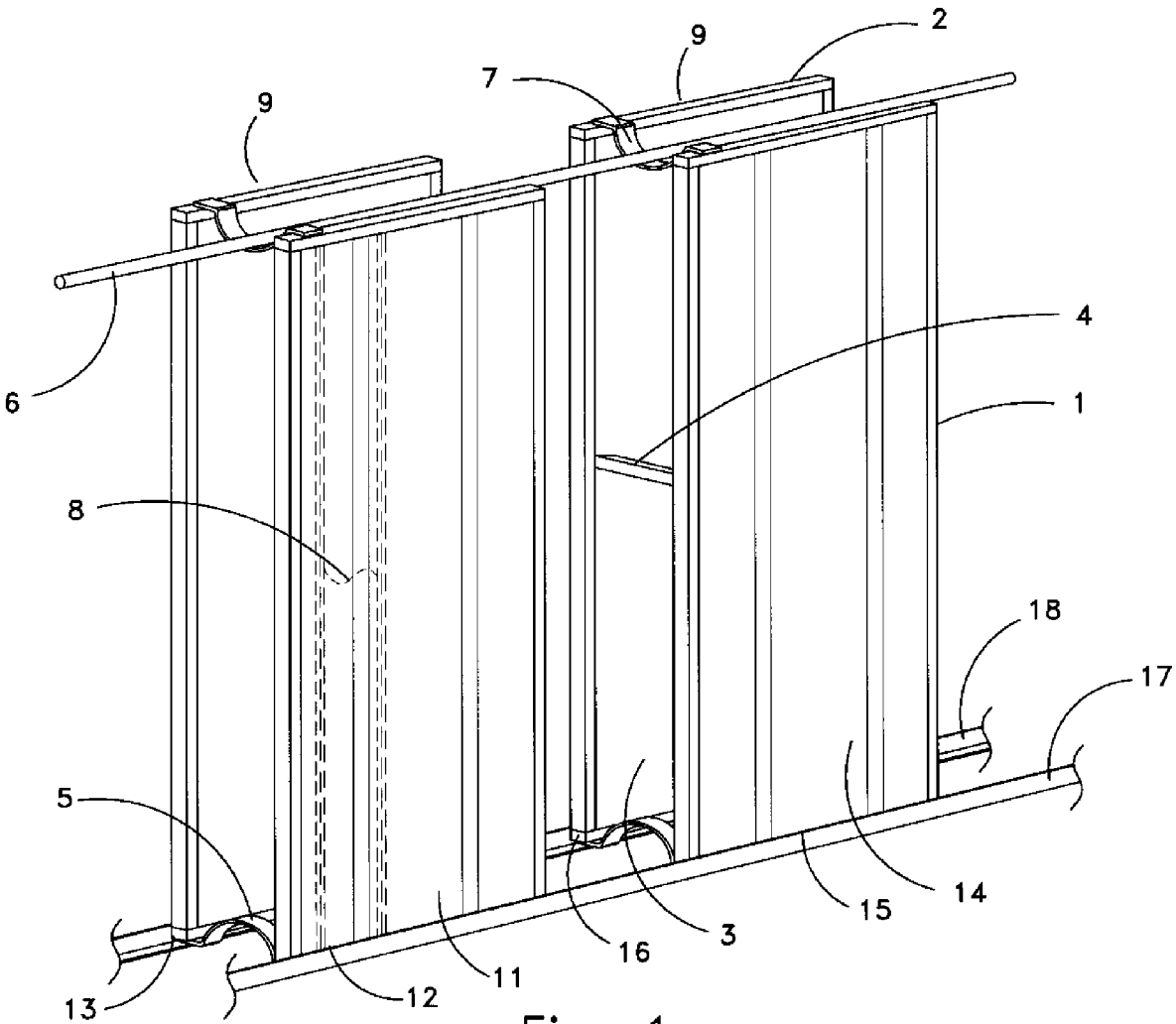
FIG. 1 shows a perspective view of two fill material forms.

Referring now primarily to FIG. 1, in some embodiments of the invention, a first forming panel (1) and a second forming panel (2) may be arranged in substantially opposed parallel orientation. A forming panel may be an object capable of forming a fill material into a shape defined at least in part by the physical definition of the forming panel. A forming panel may have a substantially planar surface or may have a non-planar surface, which may include a curved surface. A parallel orientation into which forming panels may be arranged may include forming panels arranged so as to be substantially equidistant from one another. Configurations into which forming panels are substantially equidistant to one another may include equidistant lines, equidistant curves, equidistant flat planes, equidistant curved planes, and concentric spherical surfaces or portions thereof. An opposed orientation into which forming panels may be arranged may include panels placed so as to be opposite to one another. It may readily be appreciated by those skilled in the art that the dimensions of a panel may vary depending on the specific application for which the panel may be used, including panels which may have a vertical axis longer than a horizontal axis and panels which may have a horizontal axis longer than a vertical axis. It also may be appreciated by those skilled in the art that a panel may include openings within the panel, including for example but not limited to window openings or door openings.

In certain applications, a forming panel may be an insulating forming panel. An insulating forming panel may be a forming panel having insulating properties, which under some circumstances may include a forming panel made out of an insulting material. Such insulating materials may include expanded polystyrene or extruded polystyrene, or may include other materials typically used in the construction industry to impart insulating properties to a building structure. In other applications, the materials out of which a forming panel may be made may be selected without regard to insulating properties. Such materials may include wood, fiber, polymer, steel, metal alloy, epoxy, or plastic composite.

Certain embodiments of the invention may include a first forming panel (1) and a second forming panel (2) that may be arranged to form a space (3). The space (3) may exist between a first forming panel (1) and a second forming panel (2) arranged in substantially opposed parallel orientation. The width of the space (3) may be varied depending on the application for which the panels are to be used. In some applications, this may include pouring a fill material into a space (3) of a fill material forming panel (9).

A first forming panel (1) and a second forming panel (2) may in certain embodiments of the invention be joined by a connection element (4). A connection element (4) may be an element that is joined to both first forming panel (1) and second forming panel (2).

In some applications, a connection element (4) may be a rigid tie (5). This may be merely a tie that is substantially rigid, such as a tie that maintains its shape in the course of conditions usually encountered. The rigid tie (5) also may maintain a separation distance between a first forming panel (1) and a second forming panel (2). Such a rigid tie may be established as a rigid separation distance maintenance element. Maintenance of a separation distance may include preserving the width of space (3) between a first forming panel (1) and a second forming panel (2).

In other applications, a connection element (4) may be a flexible tie (8). This may be merely a tie that is substantially flexible, such as a tie that is substantially deformable in the course of conditions usually encountered. Under some circumstances, a connection element that is substantially deformable may include a folding tie, a pivot tie, an elastic tie, a wire tie, a monofilament tie, a frictional surface tie, or a flexible mesh tie. A folding tie may be a tie having a portion capable bending over upon itself. A pivot tie may be a tie having a point about which two or more portions of the tie may rotate. An elastic tie may be a tie capable of returning to its original configuration after being stretched, compressed, expanded, or otherwise deformed. A wire tie may be a tie configured as a cord, cable, or related structure. A monofilament tie may be a tie made of a single fibrous element. A frictional surface tie may be a tie in which two surfaces are joined at an interface that is resistive to motion. A flexible mesh tie may be a tie made of a substantially flexible network of interwoven or interlinked elements.

A flexible tie (8) also may maintain a separation distance between a first forming panel (1) and a second forming panel (2). Such a flexible tie may be established as a flexible separation distance maintenance element. Maintenance of a separation distance may include preserving the width of space (3) between a first forming panel (1) and a second forming panel (2). Preservation of the width of space (3) may include holding a first forming panel (1) and a second forming panel (2) in place so as to prevent first forming panel (1) or second forming panel (2) from falling out of position and changing the width of space (3).

In some embodiments of the invention, a flexible tie (8) also may be adapted to permit a first forming panel (1) to be collapsed with respect to second forming panel (2). Collapsing a first forming panel (1) and a second forming panel (2) may include bringing a first forming panel (1) and a second forming panel (2) into substantial contact so as to substantially eliminate space (3) between a first forming panel (1) and a second forming panel (2). Adapting a flexible tie (8) to allow for a first forming panel (1) and a second forming panel (2) to be collapsed may include substantially deforming flexible tie (8) so as to bring a first forming panel (1) and a second forming panel (2) into substantial contact.

In other embodiments of the invention, a connection element (4) may be an adjustable tie. An adjustable tie may be a tie the length of which may be adjusted in order to vary the width of space (3) formed between a first forming panel (1)

and a second forming panel (2). An adjustable tie may be a crimp-adjustable tie. A crimp-adjustable tie may be a tie the length of which may be adjusted by crimping or perhaps deforming some area or perhaps even a portion of the length of a tie. Crimping at least a portion of the length of a tie may include pinching at least one fold into at least a portion of the length of a tie, although many other arrangements are possible.

In certain embodiments of the invention, a reinforcement member (6) may be placed within space (3). A reinforcement member (6) may be a member intended to be embedded within a hardened form that may even confer strength to a hardened form. In some applications, a reinforcement member (6) may be a metal reinforcement bar, or perhaps rebar. A reinforcement member (6) may be placed within space (3) by horizontally or vertically inserting reinforcement member (6) into space (3). A reinforcement member (6) also may be placed in a horizontal orientation or a vertical orientation. A horizontal orientation of reinforcement member (6) may be an orientation parallel to a top side or an under side of space (3) formed by a first forming panel (1) and a second forming panel (2). A vertical orientation may be an orientation parallel to a left side or a right side of space (3) formed by a first forming panel (1) and a second forming panel (2). A reinforcement member (6) also may be placed within a space (3) at a remote location, at a ground location, or at a placement location. It also may be that a reinforcement member (6) is placed within a space (3) before a modular concrete forming structure (10) is lifted. This may be because placing a reinforcement member (6) within a space (3) before a modular fill material forming co-joined assembly (10) is lifted may reduce the increased time, effort, and difficulty that may result from placing a reinforcement member (6) within a space (3) at a location of a modular fill material forming co-joined assembly (10) after a modular fill material forming co-joined assembly (10) is lifted.

Under some circumstances, a rigid tie (5) also may be adapted to be joined to a reinforcement member (6). Adapting rigid tie (5) to be joined to reinforcement member (6) may include fabricating rigid tie (5) to receive a reinforcement member (6). A rigid tie (5) may be fabricated to include a cradle (7). A cradle (7) may be a shape of rigid tie (5) adapted to receive and hold in place to some degree a reinforcement member (6).

Under other circumstances, a flexible tie (8) may be adapted to be joined to a reinforcement member (6). Adapting flexible tie (8) to be joined to reinforcement member (6) may include spreading a flexible tie (8) to place flexible tie (8) under tension. Spreading flexible tie (8) may be accomplished by increasing the width of space (3) between a first forming panel (1) and a second forming panel (2) to which flexible tie (8) may be connected. A tension experienced by spreading flexible tie (8) may allow flexible tie (8) to acquire a degree of stiffness. A degree of stiffness acquired by flexible tie (8) may provide sufficient support to join a reinforcement member (6) to flexible tie (8).

In may also be that a reinforcement member (6) may be joined to connection element (4). Joining reinforcement element (6) to connection element (4) may include tying down reinforcement element (6) to connection element (4).

In some embodiments of the invention, a fill material form (9) may be established by having at least a first forming panel (1) and a second forming panel (2) arranged in substantially opposed parallel orientation with a space (3) between a first forming panel (1) and a second forming panel (2) and a connection element (4) joined to at least a first forming panel (1) and a second forming panel (2). It further may be understood by those skilled in the art that a first forming panel (1) and a second forming panel (2) may further themselves be formed by joining together a number of sub-panels.

Figure 2:
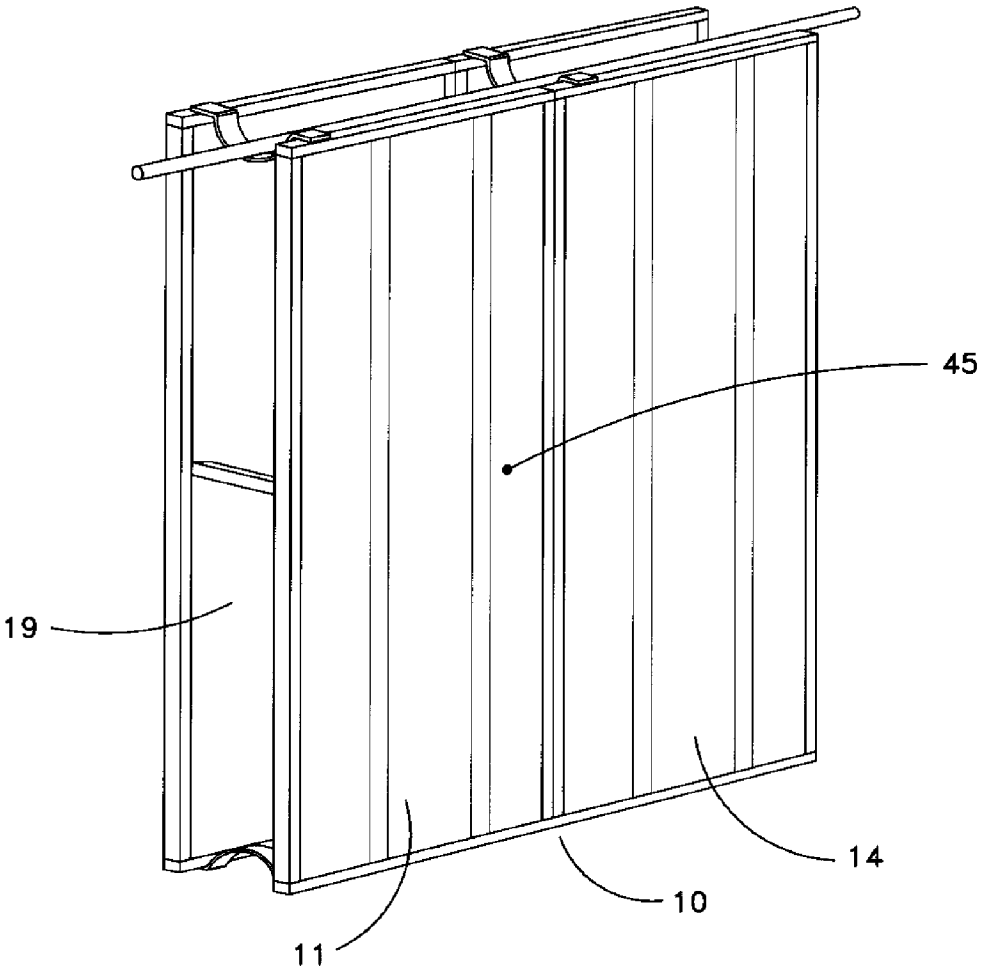
FIG. 2 shows a perspective view of two fill material forms joined to create a modular fill material forming co-joined assembly.

Referring now primarily to FIG. 2, in some embodiments of the invention, at least two fill material forms may be joined to create a modular fill material forming co-joined assembly (10). In some applications, a modular fill material forming co-joined assembly (10) may be joined at a remote location. A remote location may be a location that is distant from a ground location and a placement location, perhaps even a factory site. A factory site may be a site at which forming panels and fill material forms are fabricated. A modular fill material forming co-joined assembly (10) joined at a remote location further may be transported from a remote location to a ground location. A ground location may be a location at a building structure site of a modular fill material forming co-joined assembly (10) prior to lifting a modular fill material forming co-joined assembly (10) and transporting a modular fill material forming co-joined assembly (10) to a placement location. A building structure site may be a site at which a building structure is constructed. Under some circumstances, a modular fill material forming co-joined assembly (10) also may be joined at a ground location, perhaps at the building structure site.

Referring again primarily to FIG. 1, In certain embodiments of the invention, a first fill material form (11) may have a first edge (12) and a second edge (13), and a second fill material form (14) may have a third edge (15) and a fourth edge (16). In some applications, a first fill material form (11) may be joined to a second fill material form (14) by joining a first rail (17) to a first edge (12) and a third edge (15). In other applications, a first fill material form (11) may be joined to a second fill material form (14) by joining a second rail (18) to a second edge (13) and a fourth edge (16). In other situations, a first fill material form (11) may be joined to a second fill material form (14) in the manner described by substituting a first clip for said first rail (17) and a second clip for said second rail (18). It further will be appreciated by those skilled in the art that any manner of suitable fastener or connection element may be used to join a first fill material form (11) and a second fill material form (14).

Referring again primarily to FIG. 2, certain embodiments of the invention may permit a first fill material form (11) to be joined to a second fill material form (14) to create a cavity (19) of a modular fill material forming co-joined assembly (10) defined by communication of each said space (3) of a first fill material form (11) and a second fill material form (14).

Figure 3:
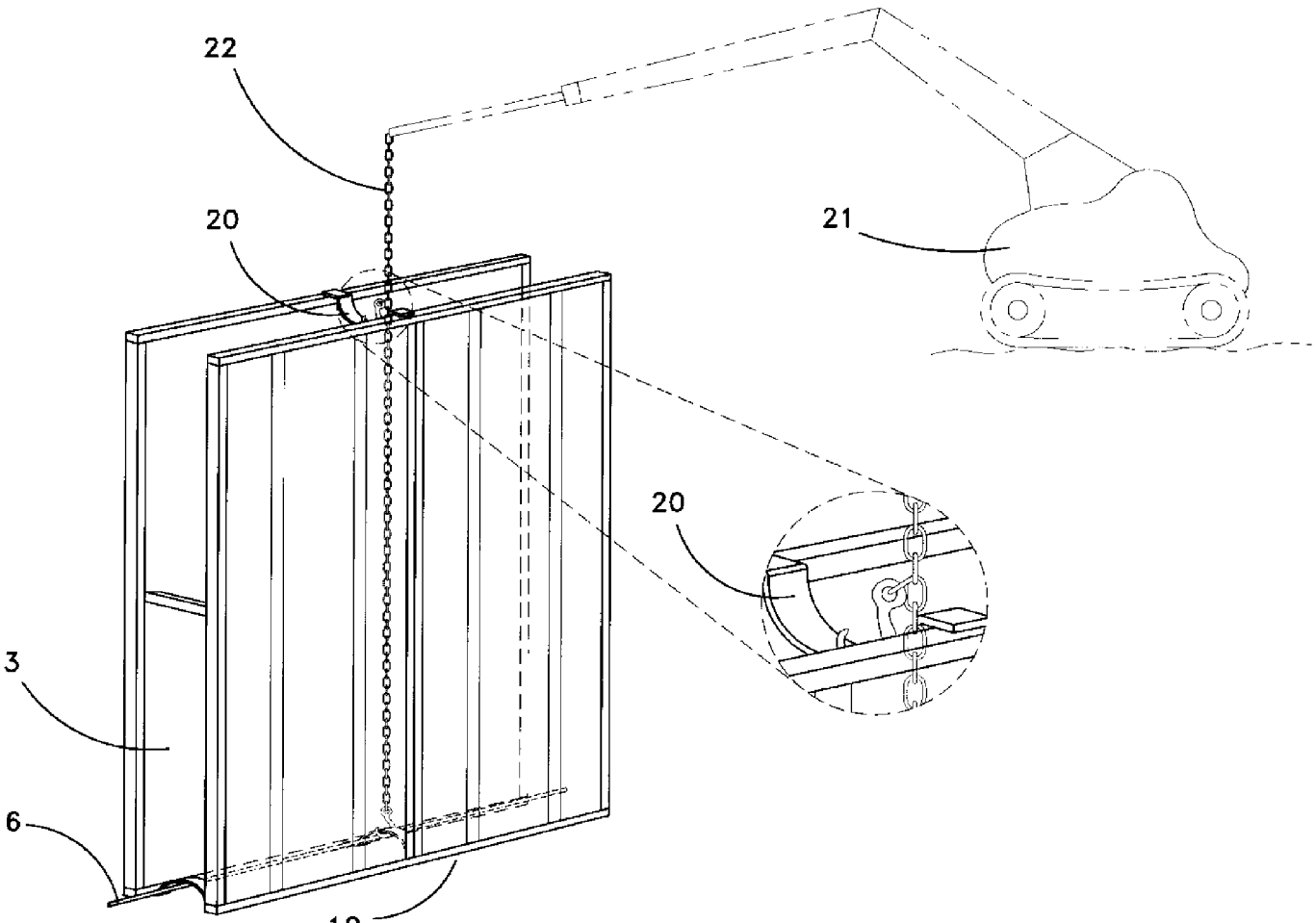
FIG. 3 shows a perspective view of a modular fill material forming co-joined assembly attached to an aerial conveyance device.

Now referring primarily to FIG. 3, in some embodiments of the invention, a lift securement element (20) may be established on a modular fill material forming co-joined assembly (10). A lift securement element (20) may be an element to which a lift attachment element (22) may be connected without structural or other damage to the modular fill material forming co-joined assembly (10). In some applications, a lift securement element (20) may be a hook, clasp, ring, frictional surface, weld, tie, strap, mechanical fastener, or connector.

In other applications, a lift securement element (20) may be a reinforcement member (6). A reinforcement member (6) may be placed in a space (3) in a horizontal orientation or a vertical orientation. A lift securement element (20) that may be a reinforcement element (6) may further be adapted for connection to a lift attachment element (22). Adapting a reinforcement member (6) for connection to a lift attachment element (22) may include forming a shape of reinforcement element (6) that facilitates connection of reinforcement element (6) to lift attachment element (22).

Certain embodiments of the invention may include establishing an aerial conveyance device (21). An aerial conveyance device (21) may be a crane, an elevator, a lift, a pulley system, an aircraft, or a lifting system. It may be that a lift attachment element (22) may be established on an aerial conveyance device (21). A lift attachment element (22) may be an element that may connect to lift securement element (20). In some applications, a lift attachment element (22) may be a hook, clasp, crimp, ring, tong, frictional surface, weld, tie, strap, mechanical fastener, or connector. In other applications, a lift attachment element (22) may further be adapted for connection to a lift securement element (20) that is a reinforcement member (6). Adapting a lift attachment element (22) for connection to a reinforcement member (6) may include forming a shape of lift attachment element (22) that facilitates connection of lift attachment element (22) to reinforcement member (6).

In some embodiments of the invention, a securement integrity system may be established on a modular fill material forming co-joined assembly. A securement integrity system may be a system to fortify a structural integrity of a modular fill material forming co-joined assembly (10) during lifting or transporting of a modular fill material forming co-joined assembly (10). Fortification of structural integrity may include strengthening structural integrity to enable a modular fill material forming co-joined assembly to better withstand stresses that may be induced by lifting and transporting, especially if loaded with rebar. Accordingly, at least one strengthening element may be established on a modular fill material forming co-joined assembly (10). A strengthening element may be an element that imparts adequate or perhaps merely increased strength to the structural integrity of a modular fill material forming co-joined assembly (10). Under some circumstances, a strengthening element may be a high-strength fastener joining a lift securement element (20) to a component of a modular fill material forming co-joined assembly (10).

Of course, a modular fill material forming co-joined assembly (10) may have a centroid (45). Under some circumstances, it may be that a centroid (45) of a modular fill material forming co-joined assembly (10) may be estimated prior to positioning a lift securement element (20). In some applications, a centroid (45) of a modular fill material forming co-joined assembly (10) may be a mass centroid (45) or an area centroid (45). A centroid (45) of a modular fill material forming co-joined assembly (10) may further have an axis of lift. An axis of lift for a centroid (45) of a modular fill material forming co-joined assembly (10) may be an axis oriented in the direction in which a modular fill material forming co-joined assembly (10) may be lifted. In some situations, an axis of lift for a centroid (45) of a modular fill material forming co-joined assembly (10) may be an axis substantially between a centroid (45) of a modular fill material forming co-joined assembly (10) and the location of a lift securement element (20) established on a modular fill material forming co-joined assembly (10). In other situations, an axis of lift for a centroid (45) of a modular fill material forming co-joined assembly (10) may be an axis substantially between a centroid (45) of a modular fill material forming co-joined assembly (10) and the location of a vector sum of the lifting vectors of more than one lift securement element (20).

It may be that at least one lift securement element (20) may be positioned to correlate with the desired placement orientation, perhaps at least about a vertical axis, which may be an axis of lift for a centroid (45) of a modular fill material forming co-joined assembly (10). A position of a lift securement element (20) may be correlated with an axis of lift for a centroid (45) of a modular fill material forming co-joined assembly (10) by being relationally responsive to an axis of lift for a centroid (45) of a modular fill material forming co-joined assembly (10). Under some circumstances, it may be that at least one lift securement element (20) may be relationally responsive to an axis of lift for a centroid (45) of a modular fill material forming co-joined assembly (10) by being symmetrically arranged about an axis of lift for a centroid (45) of a modular fill material forming co-joined assembly (10). Such a lift securement element (20) may be established as a lift axis centroidally symmetric lift securement element.

In certain embodiments of the invention, a modular fill material forming co-joined assembly (10) may be established at a ground location. A modular fill material forming co-joined assembly (10) at a ground location may have a ground orientation corresponding an orientation of a modular fill material forming co-joined assembly at a ground location. A ground orientation of the modular fill material forming co-joined assembly (10) may be established to substantially coincide with an aerial orientation of a modular fill material forming co-joined assembly (10). An aerial orientation of a modular fill material forming co-joined assembly (10) may correspond to an orientation of a modular fill material forming co-joined assembly (10) during transport of a modular fill material forming co-joined assembly (10) by an aerial conveyance device (21). A ground orientation that substantially coincides with an aerial orientation may be a ground orientation that is substantially the same as an aerial orientation.

In some embodiments of the invention, a modular fill material forming co-joined assembly (10) may be lifted from a ground location of a modular fill material forming co-joined assembly (10). Lifting a modular fill material forming co-joined assembly (10) may include removing a modular fill material forming co-joined assembly (10) from a resting surface of a ground location. A modular fill material forming co-joined assembly (10) may be lifted in a direction of an axis of lift for a centroid (45) of a modular fill material forming co-joined assembly (10). Lifting of a modular fill material forming co-joined assembly may be accomplished by connecting at least one lift securement element (20) established on a modular fill material lifting structure (10) to at least one lift attachment element (22) of an aerial conveyance device (21) and using an aerial conveyance device (21) to lift a modular fill material forming co-joined assembly (10).

Figure 4:
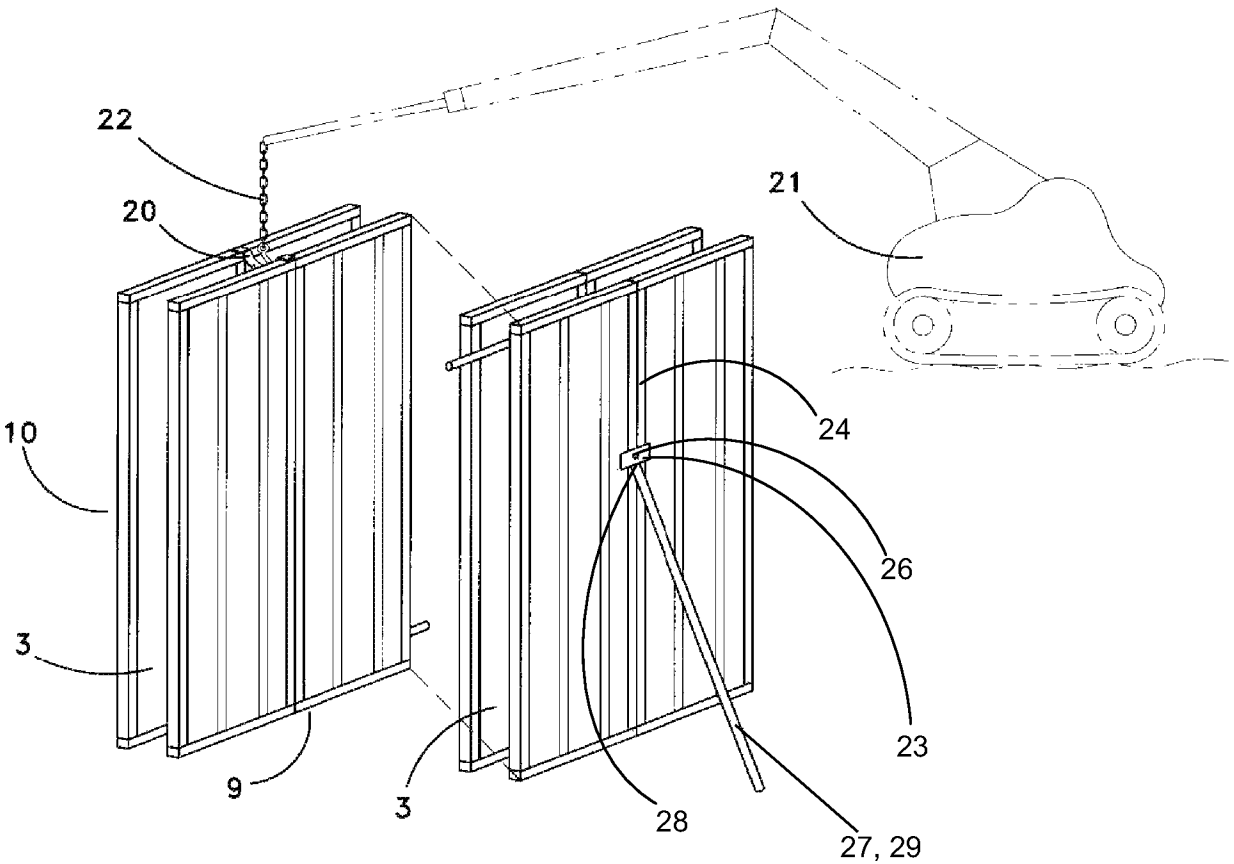
FIG. 4 shows a perspective view of a modular fill material forming co-joined assembly being placed while connected to an aerial conveyance device.

Now referring primarily to FIG. 4, in some embodiments of the invention, a modular fill material forming co-joined assembly (10) may be transported from a ground location of a modular fill material forming co-joined assembly (10) to a placement location of a modular fill material forming co-joined assembly (10). A placement location of a modular fill material forming co-joined assembly (10) may be a location at which a modular fill material forming co-joined assembly (10) is placed for use. In some applications, a placement location of a modular fill material forming co-joined assembly (10) may include a fill material pour site of a modular fill material forming co-joined assembly (10). A fill material pour site of a modular fill material forming co-joined assembly (10) may be a site at which fill material is poured into at least one space (3) of at least one fill material form (9) of a modular fill material forming co-joined assembly (10). It also may be that a fill material pour site of a modular fill material forming co-joined assembly (10) may be a high-rise fill material pour site of a modular fill material forming co-joined assembly (10). A high-rise fill material pour site of a modular fill material forming co-joined assembly (10) may be a pour site situated at a location that is at least one story above the level of a ground location of a modular fill material forming co-joined assembly (10).

Transporting a modular fill material forming co-joined assembly (10) may include transporting a modular fill material forming co-joined assembly (10) in an aerial orientation while a lift securement element (20) established on a modular fill material forming co-joined assembly (10) is connected to a lift attachment element (22) of an aerial conveyance device (21). In some applications, an aerial orientation of a modular fill material forming co-joined assembly (10) may further be established or even adjusted to substantially coincide with a placement orientation of a modular fill material forming co-joined assembly (10) while a lift securement element (20) established on a modular fill material forming co-joined assembly (10) is connected to a lift attachment element (22) of an aerial conveyance device (21). A placement orientation of a modular fill material forming co-joined assembly (10) may be an orientation at which a modular fill material placement structure (10) is placed. An aerial orientation that substantially coincides with a placement orientation may be an aerial orientation that is substantially the same as a placement orientation.

In certain embodiments of the invention, a modular fill material forming co-joined assembly (10) may be placed at a placement location. Placing a modular fill material forming co-joined assembly (10) may occur when a modular fill material forming co-joined assembly (10) is in a placement orientation and while a lift securement element (20) established on a modular fill material forming co-joined assembly (10) is connected to a lift attachment element (22) of an aerial conveyance device (21). Placing a modular fill material forming co-joined assembly (10) may further include joining a modular fill material forming co-joined assembly (10) to at least one fill material form (9) at said placement location. A lift securement element (20) established on a modular fill material forming co-joined assembly (10) may be disconnected from a lift attachment element (22) of an aerial conveyance device (21) after a modular fill material forming co-joined assembly (10) is placed.

Figure 6:
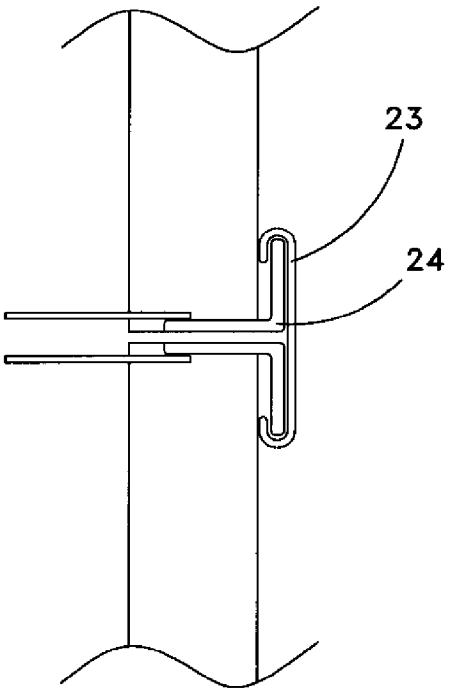
FIG. 6 shows a sectional view of a brace attachment element joined to a modular fill material forming co-joined assembly.
Figure 5:
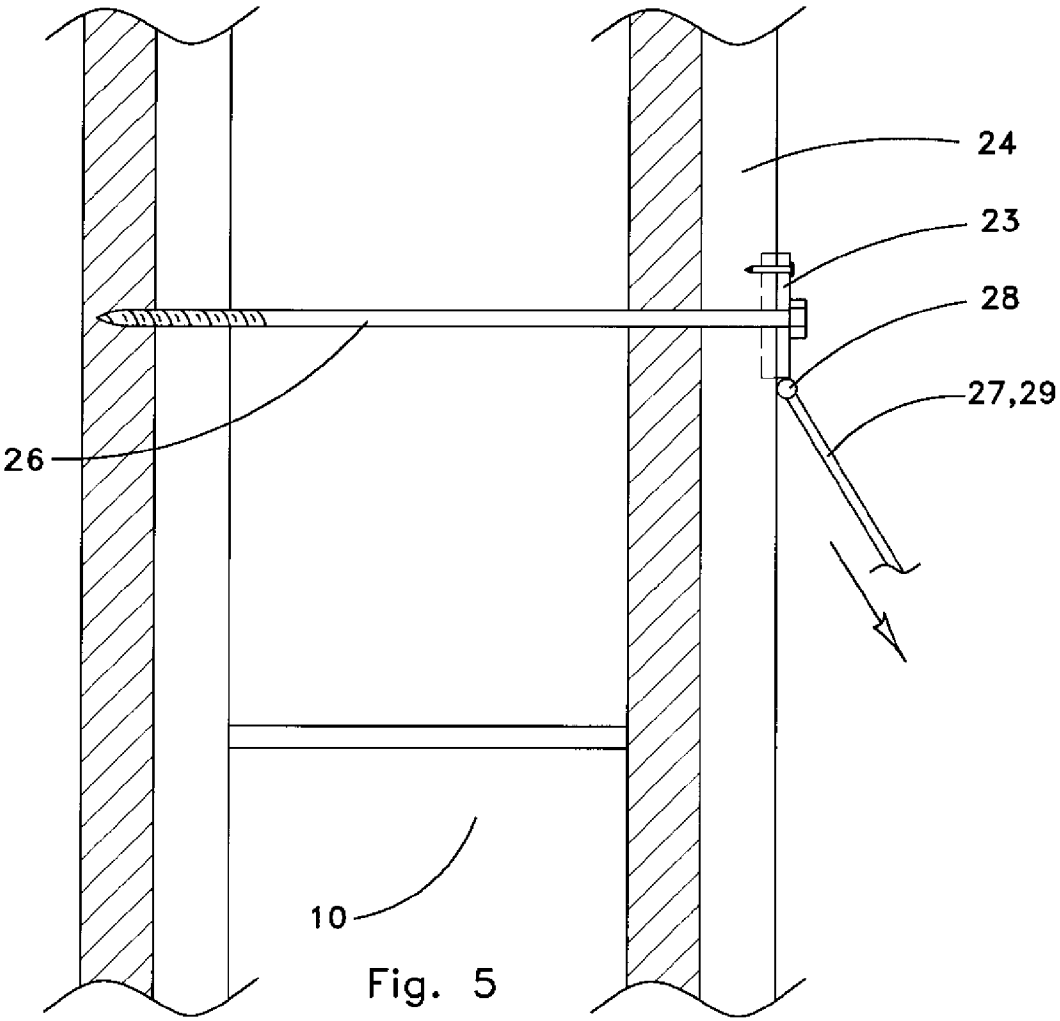
FIG. 5 shows a plan view of a brace attachment element joined to a modular fill material forming co-joined assembly.

Now referring primarily to FIG. 5 and FIG. 6, in some embodiments of the invention, a brace attachment element (23) may be affixed to a modular fill material forming co-joined assembly (10). In some applications, a brace attachment element (23) may be permanently joined to a modular fill material forming co-joined assembly (10). In other applications, a brace attachment element (23) may be temporarily joined to a modular fill material forming co-joined assembly (10).

In certain embodiments of the invention, a brace attachment element (23) may be affixed to a modular fill material forming co-joined assembly (10) in a continuously repositionable location. A continuously repositionable location may be a location the position of which may be moved and perhaps secured in any incremental position without requiring movement in discrete quantities. It may be that an exposed rail (24) may be joined to a modular fill material forming co-joined assembly (10), and a brace attachment element (23) may be configured for a slide engagement of exposed rail (24). Such a brace attachment element (23) may be established as a slide engagement brace attachment element. An opening may be established on brace attachment element (23), through which a locking element (26) may be placed. A locking element (26) placed through an opening may act to lock brace attachment element (23) in a particular position to exposed rail (24). A locking element (26) may be a screw. A locking element (26) that is a screw may be a self-tapping screw. Under some circumstances, a brace attachment element (23) may be locked in place by a self-tapping screw that is embedded in exposed rail (24). A self-tapping screw may even penetrate through an exposed rail (24) and a first forming panel (1), embedding itself in a second forming panel (2).

In some applications, a brace (27) may be attached to brace attachment element (23). A brace (27) may be a kicker (29). Under some circumstances, a brace (27) may be attached to brace attachment element (23) through a pivot point (28). A brace (27) also may be anchored to an anchor location. In some embodiments of the invention it may be that subsequent to anchoring brace (27) at an anchor location, brace attachment element (23) may be continuously repositioned to a desired location established on a modular fill material forming co-joined assembly (10) and locked down at a desired location using locking element (26). A desired location may be a location at which a modular fill material forming co-joined assembly (10) may be in a plumb position. It also may be that a brace (27) anchored to an anchor location and attached to brace attachment element (23) locked at a desired location may support a modular fill material forming co-joined assembly (10).

In some embodiments of the invention, a brace attachment element (23) may be rapidly deployed. A deployment of brace attachment element (23) may include continuously repositioning brace attachment element (23) to a desired location and locking brace attachment element (23) in place at a desired location. In some applications, a deployment may include locking brace attachment (23) in place at a desired location using a screw. A rapid deployment of brace attachment element (23) may include deploying brace attachment element (23) in a period of time that may be selected from the group consisting of about 90 seconds, about 2 minutes, about 3 minutes, about 5 minutes, or about 10 minutes.

Figure 7:
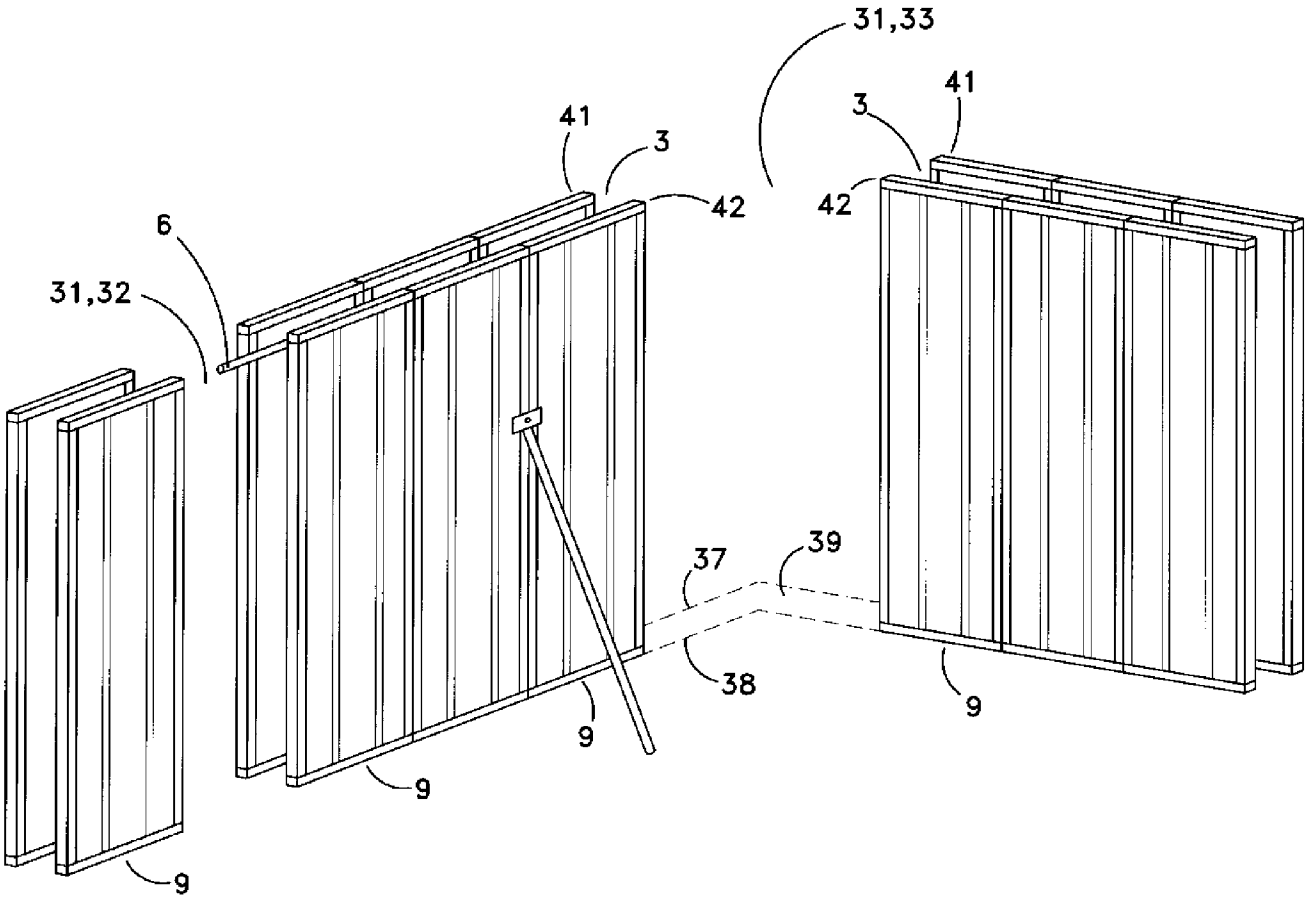
FIG. 7 shows a perspective view of two enclosure locations formed between placed modular fill material forming co-joined assemblies.

Now referring primarily to FIG. 7, it can be seen that an enclosure location (31) may be established. At least two fill material forms (9) may be placed adjacent to enclosure location (31). Each fill material form (9) may have an outer panel (41), an inner panel (42) and a space (3) formed between an outer panel (41) and an inner panel (42). A reinforcement member (6) may be placed within space (3) of each fill material form (9).

In certain embodiments of the invention, an enclosure location (31) may be an in-line opening (32) established between at least two fill material forms (9) placed adjacent to an enclosure location (31). It may be readily understood by those skilled in the art that such an in-line opening may include an opening for a door, for a window, or for another type of opening that may be necessary or desirable in a construction industry application. An in-line opening (32) established between at least two fill material forms (9) may have a width selected from the group consisting of about 1 foot, about 2 feet, about 5 feet, or about 15 feet. In other embodiments of the invention, an enclosure location (31) may be a corner opening (33) established between at least two fill material forms (9) placed adjacent to an enclosure location (31). It may be readily understood by those skilled in the art that such a corner opening may include an opening for a door, for a window, or for another type of opening that may be necessary or desirable in a construction industry application. A corner opening (33) established between at least two fill material forms (9) may have a width selected from the group consisting of about 1 foot, about 2 feet, about 5 feet, or about 15 feet. An enclosure location (31) may be a fill material pour site. An enclosure location (31) that is a fill material pour site may be a high-rise fill material pour site.

In some embodiments of the invention, an outer enclosure forming panel (34), an inner enclosure forming panel (35), and an enclosure reinforcement member (36) may be transported to an enclosure location (31). An enclosure location (31) may have an outside enclosure boundary (37), an inside enclosure boundary (38), and an enclosure space (39). An enclosure space (39) may be a space formed between an outside enclosure boundary (37) and an inside enclosure boundary (38). An outside enclosure boundary (37) may be the boundary at which an outer enclosure forming panel (34) may need to be approximately positioned in order to enclose an enclosure location (31). In some applications, an outside enclosure boundary may be configured to include two straight lines joined at an angle. Under some circumstances, an outer enclosure forming panel (34) may enclose an enclosure location (31) by being joined to each outer panel of each adjacent fill material form (9). An inside enclosure boundary (38) may be the boundary at which an inner enclosure forming panel (35) may need to be positioned in order to enclose an enclosure location (31). In some applications, an inside enclosure boundary may be configured to include two straight lines joined at an angle. Under some circumstances, an inner enclosure forming panel (35) may enclose an enclosure location (31) by being joined to each inner panel of each adjacent fill material form (9).

Figure 8:
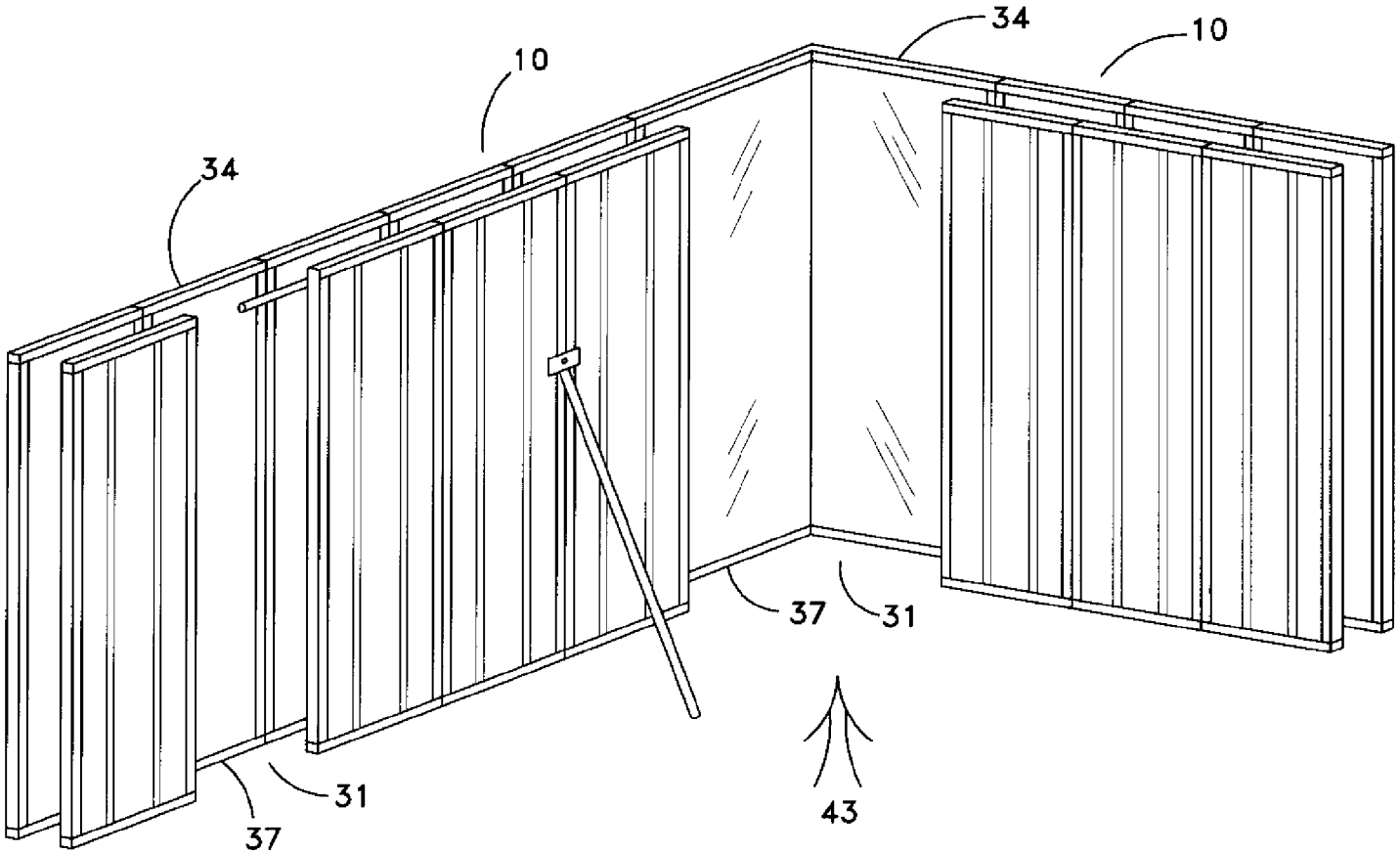
FIG. 8 shows a perspective view of two outer enclosure forming panels placed at two enclosure locations.

Now referring primarily to FIG. 8, in some embodiments of the invention, an outer enclosure forming panel (34) may oriented to substantially coincide with an outside enclosure boundary (37) of enclosure location (31). An orientation of outer enclosure forming panel (34) that substantially coincides with an outside corner boundary (37) may be an orientation of outer enclosure forming panel (34) that is substantially the same as outside corner boundary (37). In some situations, an outer enclosure forming panel (34) may then be positioned substantially at outside enclosure boundary (37). In other situations, an outer enclosure forming panel (34) may be positioned substantially at outside enclosure boundary (37) after a modular fill material forming co-joined assembly (10) is placed on either side of enclosure location (31). In further situations, an outer enclosure forming panel (34) may be positioned substantially at outside enclosure boundary (37) from an inside direction (43). An inside direction (43) may be that direction corresponding to the side of enclosure location (31) at which inner enclosure forming panel (35) is placed and from which access without exterior support is necessary.

In some applications, a lift securement element (20) may be established on an outer enclosure forming panel (34). A lift securement element (20) established on an outer enclosure forming panel (34) may be connected to a lift attachment element (22) of an aerial conveyance device (21). An outer enclosure forming panel (34) which may then be positioned substantially at outside enclosure boundary (37) may be positioned while lift securement element (20) is connected to lift attachment element (22).

Figure 9:
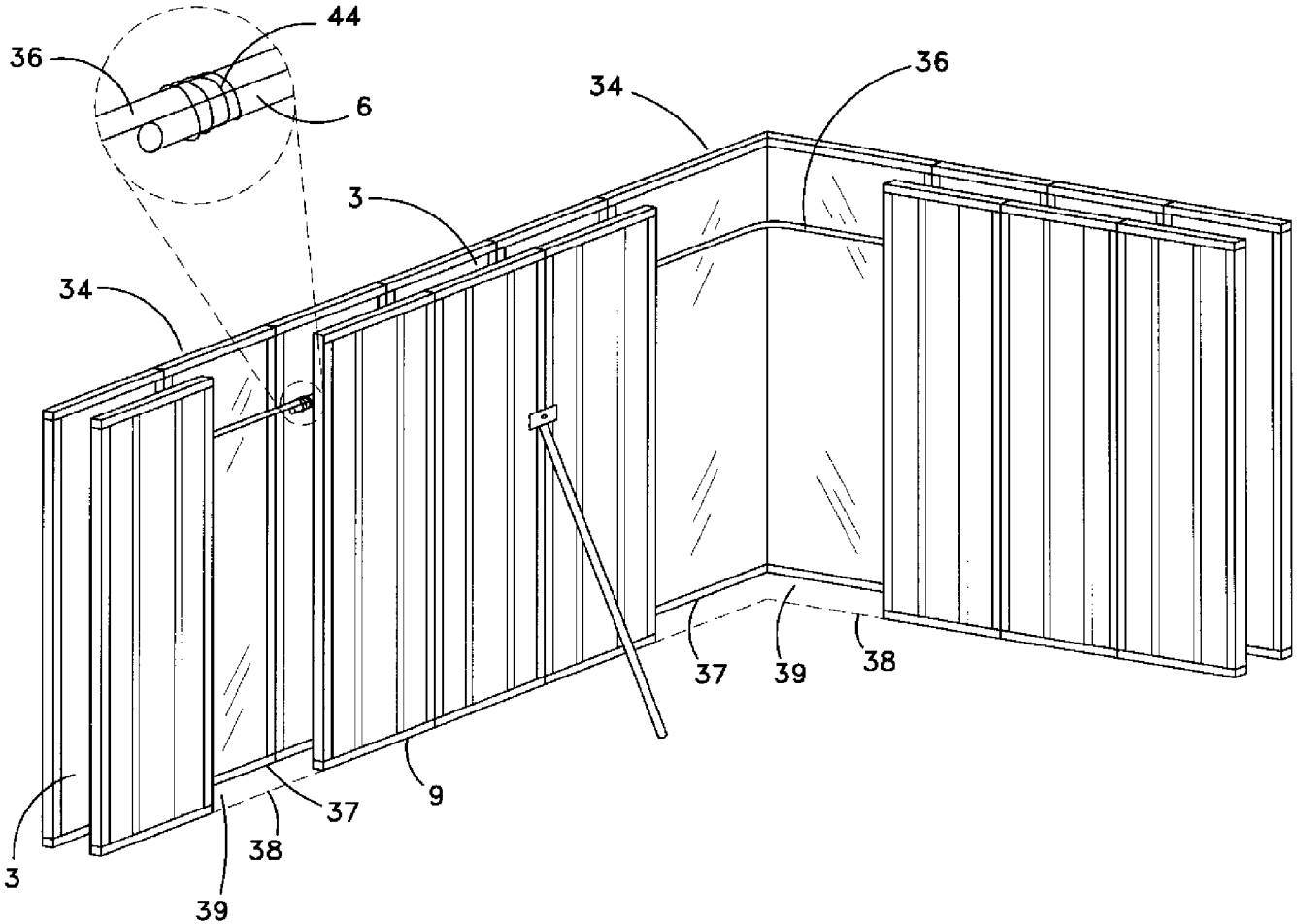
FIG. 9 shows a perspective view of two enclosure reinforcement members placed at two enclosure spaces.

Now referring primarily to FIG. 9, in some embodiments of the invention, an enclosure reinforcement member (36) may be oriented to fit within enclosure space (39). An enclosure reinforcement member (36) may then be placed within enclosure space (39). Under some circumstances, an enclosure reinforcement member (36) may be placed within enclosure space (39) after an outer corner forming panel (34) may be positioned substantially at outside enclosure boundary (37). A lift securement element (20) also may be established on an enclosure reinforcement member (36). A lift securement element (20) established on an enclosure reinforcement member (36) may be connected to a lift attachment element (22) of an aerial conveyance device (21). An enclosure reinforcement member (36) which may then be placed within an enclosure space (39) may be placed while lift securement element (20) is connected to lift attachment element (22).

In certain embodiments of the invention, an enclosure reinforcement member (36) also may be joined to a reinforcement member (6) placed within space (3) of fill material form (9). An enclosure reinforcement member (36) joined to reinforcement member (6) may be tied down (44) to reinforcement member (6). An enclosure reinforcement member (36) may be a metal reinforcement bar. In some situations, an enclosure reinforcement member (36) may be oriented with enclosure space (39) in a horizontal orientation or a vertical orientation.

Figure 10:
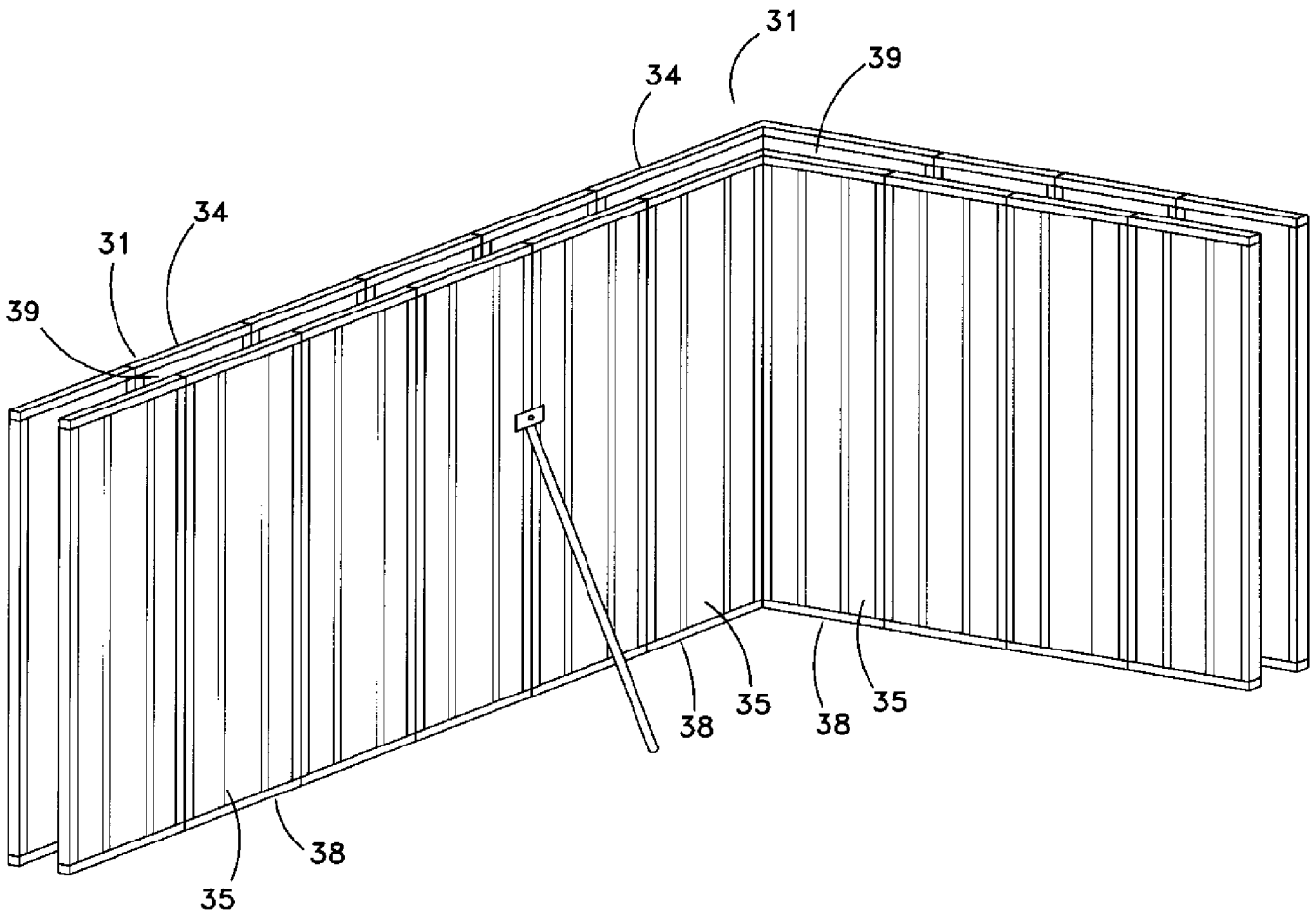
FIG. 10 shows a perspective view of two inner enclosure forming panels placed between two modular fill material forming co-joined assemblies.

Now referring primarily to FIG. 10, in some embodiments of the invention, an inner enclosure forming panel (35) may be oriented to substantially coincide with an inside enclosure boundary (38) of enclosure location (31). An orientation of inner enclosure forming panel (35) that substantially coincides with an inside corner boundary (38) may be an orientation of inner enclosure forming panel (35) that is substantially the same as inside corner boundary (38). In some applications, an inner enclosure forming panel (35) may then be positioned at inside enclosure boundary (38). In other applications, an inner enclosure forming panel (35) may be positioned substantially at inside enclosure boundary (38) after an enclosure reinforcement member (36) may be placed within enclosure space (39). A lift securement element (20) also may be established on an inner enclosure forming panel (35). A lift securement element (20) established on an inner enclosure forming panel (35) may be connected to a lift attachment element (22) of an aerial conveyance device (21). An inner enclosure forming panel (35) which may then be positioned substantially at inside enclosure boundary (38) may be positioned while lift securement element (20) is connected to lift attachment element (22).

In some embodiments of the invention, an enclosure connection element may be joined to both an outer enclosure forming panel (34) and an inner enclosure forming panel (35). An enclosure connection element may be a connection element (4) utilized in a corner location (31). In some applications, an outer enclosure forming panel (34) may be substantially braced by inner enclosure forming panel (35). Outer enclosure forming panel (34) substantially braced by inner enclosure forming panel (35) may be braced substantially by the connection of an enclosure connection element to both outer enclosure forming panel (34) and inner enclosure forming panel (35).

Now referring to FIGS. 1-10, in some embodiments of the invention, a fill material may be poured into at least one space (3) of at least one fill material form (9) of a modular fill material forming co-joined assembly (10). A fill material may be a substantially fluid fill material capable of hardening into a hardened form. In some applications, a fluid fill material capable of hardening into a hardened form may be concrete. A fill material poured into at least one space (3) of at least one fill material form (9) of a modular fill material forming co-joined assembly (10) may be molded into a shape defined by a modular fill material forming co-joined assembly. In some applications, a hardened form substantially made of a fill material may be a wall. It may be the case that a modular fill material forming co-joined assembly (10) may be removed from a hardened form after a fill material has hardened. A building structure may be created having a hardened form as at least one component. A building structure may include a building, tower, edifice, monument, or other residential, commercial or industrial structure.

As can be easily understood from the foregoing, the basic concepts of the present invention may be embodied in a variety of ways. It involves both modular fill material forming co-joined assembly placement techniques as well as devices to accomplish the appropriate placement of modular fill material forming co-joined assemblies. In this application, the modular fill material forming co-joined assembly placement techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure. With this understanding, the reader should be aware that this disclosure is to be understood to support as broad a base of claims as deemed within the applicant's right and a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element that causes that action. Similarly, each physical element disclosed should be understood to encompass a disclosure of the action that that physical element facilitates. Regarding this last aspect, as but one example, the disclosure of an "aerial conveyance device" should be understood to encompass disclosure of the act of "aerially conveying"—whether explicitly discussed or not—and, conversely, were there effectively disclosure of the act of "aerially conveying", such a disclosure should be understood to encompass disclosure of an "aerial conveyance device" and even a "means for aerially conveying". Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the modular fill material forming co-joined assembly devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A method of placing modular fill material forming co-joined assemblies, comprising the steps of:

establishing at least two fill material forms, each said fill material form having at least a first forming panel and at least a second forming panel arranged in substantially opposed parallel orientation, a space formed between said at least first forming panel and said at least second forming panel, and at least one connection element joined to said first forming panel and said second forming panel;

joining said at least two fill material forms to create a modular fill material forming co-joined assembly;

establishing a ground location of said modular fill material forming co-joined assembly;

establishing a ground orientation of said modular fill material forming co-joined assembly;

estimating a centroid of said modular fill material forming co-joined assembly;

establishing at least one lift securement element on said modular fill material forming co-joined assembly;

positioning said at least one lift securement element to correlate with an axis of lift for said centroid of said modular fill material forming co-joined assembly;

establishing an aerial conveyance device having at least one lift attachment element;

connecting said at least one lift attachment element of said aerial conveyance device to said at least one lift securement element of said modular fill material forming co-joined assembly;

lifting said modular fill material forming co-joined assembly in an aerial orientation along said axis of lift for said centroid using said aerial conveyance device;

transporting said modular fill material forming co-joined assembly in said aerial orientation from said ground location to a placement location using said aerial conveyance device;

establishing an aerial orientation of said modular fill material forming co-joined assembly to substantially coincide with said placement orientation of said modular fill material forming co-joined assembly while said at least one lift attachment element of said aerial conveyance device is connected to said at least one lift securement element of said modular fill material forming co-joined assembly;

placing said modular fill material forming co-joined assembly oriented in said placement orientation in said placement location while said at least one lift attachment element of said aerial conveyance device is connected to said at least one lift securement element of said modular fill material forming co-joined assembly; and disconnecting said at least one lift attachment element of said aerial conveyance device from said at least one lift securement element of said modular fill material forming co-joined assembly.

2. A method of placing modular fill material forming co-joined assemblies as described in claim 1, further comprising the step of placing at least one reinforcement member at a remote location.

3. A method of placing modular fill material forming co-joined assemblies as described in claim 2, wherein said step of placing said reinforcement member occurs before said step of lifting said modular fill material forming co-joined assembly.

4. A method of placing modular fill material forming co-joined assemblies as described in claim 1, wherein said step of joining occurs at a remote location.

5. A method of placing modular fill material forming co-joined assemblies as described in claim 4, wherein said remote location comprises a factory site.

6. A method of placing modular fill material forming co-joined assemblies as described in claim 1, wherein said placement location comprises a high-rise fill material pour site.

7. A method of placing modular fill material forming co-joined assemblies as described in claim 1, further comprising the step of establishing a securement integrity system to fortify a structural integrity of said modular fill material forming co-joined assembly during said step of transporting said modular fill material forming co-joined assembly.

8. A method of placing modular fill material forming co-joined assemblies as described in claim 7, wherein said securement integrity system comprises at least one strengthening element established on said modular fill material forming co-joined assembly.

9. A method of placing modular fill material forming co-joined assemblies as described in claim 8, wherein said strengthening element comprises a high-strength fastener joining said lift securement element to said modular fill material forming co-joined assembly.

10. A method of placing modular fill material forming co-joined assemblies as described in claim 1, further comprising the steps of:

establishing an enclosure location having an outside enclosure boundary, an enclosure space, and an inside enclosure boundary;

transporting an outer enclosure forming panel to said enclosure location;

transporting at least one enclosure reinforcement member to said enclosure location;

transporting an inner enclosure forming panel to said enclosure location;

orienting said outer enclosure forming panel to substantially coincide with said outside enclosure boundary;

positioning said outer enclosure forming panel substantially at said outside enclosure boundary;

orienting said at least one enclosure reinforcement member to fit within said enclosure space;

placing said at least one enclosure reinforcement member within said enclosure space after said step of positioning said outer enclosure forming panel;

orienting said inner enclosure forming panel to substantially coincide with said inside enclosure boundary;

positioning said inner enclosure forming panel substantially at said inside enclosure boundary after said step of placing said at least one enclosure reinforcement member;

joining at least one enclosure connection element to said outer enclosure forming panel and said inner enclosure forming panel.

11. A method of placing modular fill material forming co-joined assemblies as described in claim 10, wherein said steps of establishing an enclosure location, transporting an outer enclosure forming panel, transporting at least one enclosure reinforcement member, transporting an inner enclosure forming panel, orienting said outer enclosure forming panel, positioning said outer enclosure forming panel, orienting said at least one enclosure reinforcement member, placing said at least one enclosure reinforcement member, orienting said inner enclosure forming panel, positioning said inner enclosure forming panel, and joining at least one enclosure connection element to said outer enclosure forming panel occur after said step of placing said modular fill material forming co-joined assembly.

12. A method of placing modular fill material forming co-joined assemblies as described in claim 10, wherein said enclosure location comprises a corner opening.

13. A method of placing modular fill material forming co-joined assemblies as described in claim 12, further comprising placing at least one fill material form adjacent to said corner opening.

14. A method of placing modular fill material forming co-joined assemblies as described in claim 13, further comprising joining said outer enclosure forming panel to an outer forming panel of said fill material form.

15. A method of placing modular fill material forming co-joined assemblies as described in claim 13, further comprising joining said inner enclosure forming panel to an inner forming panel of said fill material form.

16. A method of placing modular fill material forming co-joined assemblies as described in claim 13, further comprising placing at least one reinforcement member within said space of said fill material form.

17. A method of placing modular fill material forming co-joined assemblies as described in claim 16, further comprising joining said enclosure reinforcement member to said reinforcement member placed within said space of said fill material form.

18. A method of placing modular fill material forming co-joined assemblies as described in claim 12, wherein said corner opening comprises a high-rise fill material pour site.

19. A method of placing modular fill material forming co-joined assemblies as described in claim 10, wherein said step of positioning said outer enclosure forming panel comprises the step of positioning said outer enclosure forming panel from an inside direction.

* * * * *